United States Patent [19]

Peterson

[11] Patent Number: 4,854,430

[45] Date of Patent: Aug. 8, 1989

[54] EXPANDABLE CARRYING CASE WITH EXTERNAL EXPANSION CONTROL MEANS

[76] Inventor: Laverne Peterson, 98-2060 Kikala St., Aiea, Hi. 96701

[21] Appl. No.: 163,085

[22] Filed: Mar. 2, 1988

[51] Int. Cl.[4] ..... A45C 7/00; A45C 13/04

[52] U.S. Cl. ..... 190/105; 190/22; 190/108; 190/110; 190/111; 190/112; 220/8

[58] Field of Search ..... 220/8; 190/15 R, 15 A, 190/21, 22, 103–105, 107, 108, 110, 111, 112; 383/2

[56] References Cited

U.S. PATENT DOCUMENTS

| | | | |
|---|---|---|---|
| 724,985 | 4/1903 | Wohlrabe | 190/15 R |
| 892,125 | 6/1908 | Bourne | 190/104 |
| 1,052,018 | 2/1913 | Spitz | 190/104 |
| 1,490,001 | 4/1924 | Gaynor | 190/111 X |
| 2,875,868 | 3/1959 | Powell | 190/107 X |
| 3,319,744 | 5/1967 | Smith | 190/108 |
| 3,450,237 | 6/1969 | Dyke | 190/103 |
| 4,273,223 | 6/1981 | Tomlinson | 190/110 X |
| 4,630,717 | 12/1986 | Tong | 190/107 X |

FOREIGN PATENT DOCUMENTS

| | | | |
|---|---|---|---|
| 2233010 | 1/1975 | France | 190/104 |
| 1261618 | 10/1986 | U.S.S.R. | 190/104 |
| 248132 | 3/1926 | United Kingdom | 190/21 |

*Primary Examiner*—Sue A. Weaver

*Attorney, Agent, or Firm*—Richard C. Litman

[57] ABSTRACT

An expandable carrying case apparatus, having two pivotably attached members, each of which is substantially rectangular, and each of which is expandable. Expansion is accomplished by individualized displacement mechanisms deployed upon each corner of the members. Each of the displacement mechanisms is attached to a controllable driver which when actuated, expands or contracts an element of the case frame causing the exterior members to expand outwardly or contract inwardly and thereby increase or decrease the volume of the carrying case.

8 Claims, 4 Drawing Sheets

EXPANDABLE CARRYING CASE WITH EXTERNAL EXPANSION CONTROL MEANS

FIELD OF INVENTION

This invention relates to an expandable carrying case for carrying papers and other materials. The interior dimensions of the carrying case can be selectively increased or decreased to fit the requirements of the volume of materials to be carried.

BACKGROUND OF THE INVENTION

The present invention relates to carrying cases, and provides for the convenient expansion of the interior space thereof for the accommodation of larger quantities of materials. In the preferred embodiment, control means on the exterior of each section of the case engages an adjustment means that in turn engages an expansion means within housing units in each section of the case. Both sections of the case can be adjusted as desired.

As the expansion mechanism is rotated by the actuation of the adjustment device, a first and second generally rectangular exterior shell, interconnected to a middle stationary member, expand outwardly to increase the interior volume of the case. The first and second exterior shell elements slidably expand over the stationary member that is rigidly affixed to the frame of each of the two halves of the carrying case apparatus.

Further, this apparatus relates to instrumentalities for the construction of an expandable carrying case having minimal components and a structurally interlocking mechanism so as to provide a high degree of service reliability and convenience in use.

DESCRIPTION OF THE PRIOR ART

Various prior art briefcases, carrying cases and the like, as well as their construction and method of manufacture in general, are found to be exemplary of the known U.S. prior art. They are:

| U.S. Pat. No. | Inventor |
|---|---|
| 892,125 | Bourne |
| 1,052,018 | Spitz |
| 3,450,237 | Dyke |
| 4,630,717 | Tong |

U.S. Pat. No. 892,125, issued to Bourne, discloses an expandable suitcase which is operated by means of scissor-type expanders driven by a shaft within the perimeter of the case.

U.S. Pat. No. 1,052,018, to Spitz, teaches the construction of an extensible briefcase which has telescoping ends operated by a rack and pinion drive system.

U.S. Pat. No. 3,450,237, issued to Dyke, discloses an expandable carrying case. The latch, which locks the sides of the case in position, is operated by a peripheral band.

U.S. Pat. No. 4,630,717, to Tong, discloses an expandable carrying case. The case features a rotary actuated push-pull cable drive system for the expansion and reduction of each corner of the case.

These patents disclose various types of expandable cases and the like, as well as their method of construction but are not seen to disclose the specific details of the combination of the present invention in such a way as to bear upon the appended claims.

SUMMARY OF THE INVENTION

An object of this invention is to provide an expandable carrying case that is adjustable with a simple control mechanism that further has a reliable, peripherally disposed mechanism to provide an uncluttered appearance, and a neat, workable and practical apparatus for expanding the interior spaces of the apparatus.

Another object of the present invention is to provide a turnbuckle type device for engaging multiple left hand and right hand threaded members, within the carrying case apparatus, that in turn slidably displaces a first and second shell elements, that in turn increase the volume within the carrying case apparatus as they are displaced.

Another object of the invention is to provide apparatus and structure for insuring strength in the fabrication and use of an expandable carrying case both in the collapsed and in the expanded mode of operation.

A still further object of the invention resides in providing a mode of operation of the device that is highly resistant to changes in temperature with the result that the device operates with equal ease and convenience in all weather and internal environments.

DESCRIPTION OF THE PREFERRED EMBODIMENT

Figure 1:
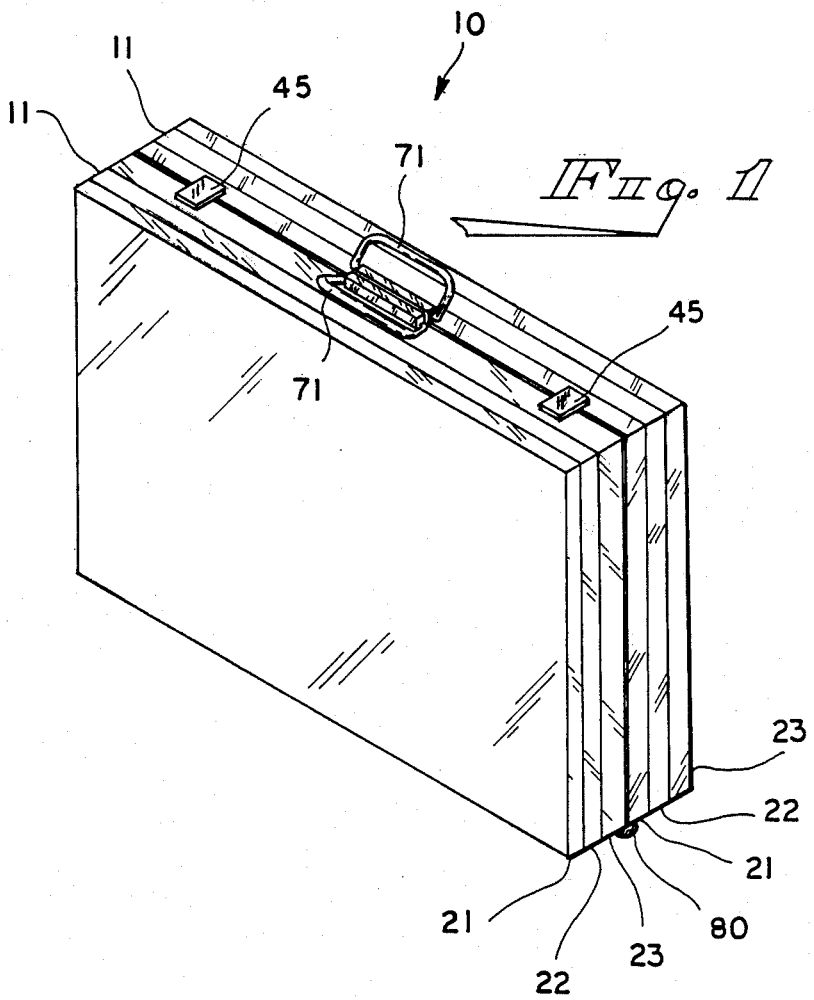
FIG. 1 is an isometric view of a closed expandable carrying case in non-expanded condition. This view illustrates the three members which comprise the frame of each case section.

Referring now to the drawings, in which like reference numerals refer to like elements throughout the drawings with corresponding parts of the different embodiments having the reference numerals primed or double-primed, there is shown in FIG. 1 an expandable carrying case 10 illustrated in a non-expanded condition. The case 10 includes two case halves 11, the two case halves 11 being connected by releasable hinges 80, such for example, as a pin-andsleeve type separable hinge of a character well-known to practitioners in the art to which this invention relates, so that the case halves 11 may be detached if desired. Each case half 11 is formed of a first case section 21, a second case section 22, and a case section 23. These case sections 21, 22, and 23 are slidably adjoined in such a manner that the case half 11 may be expanded or contracted in volume.

Figure 3:
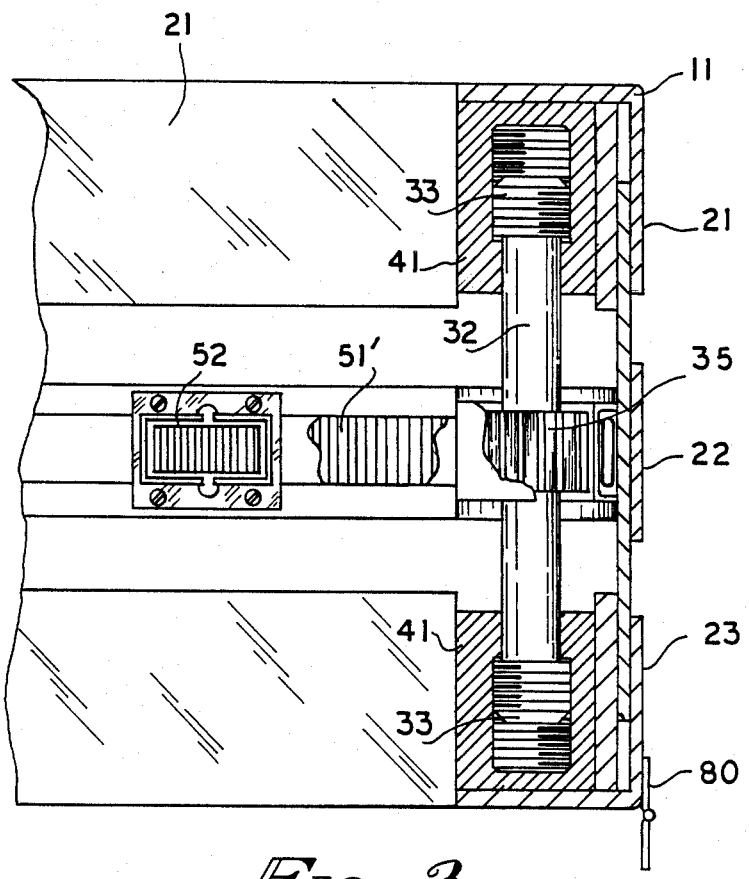
FIG. 3 is a side elevation section view of the rack-andpinion gear assembly, and the rack-like belt drive for actuation of the driven pinion gear.
Figure 4A:
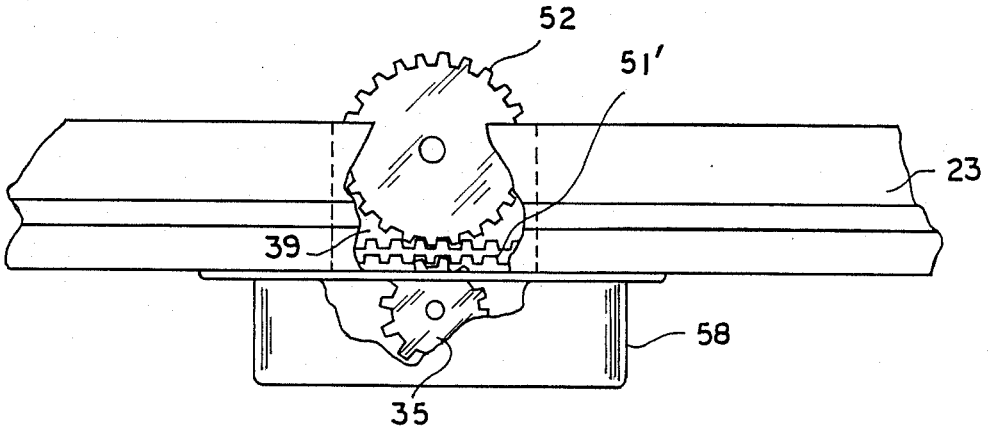
FIG. 4A is a sectional view of an alternative embodiment of the belt control drive device utilized with the expandable carrying case of the invention.

The expansion or contraction is accomplished by actuating control wheel 52, as best illustrated in FIGS. 3 and 4A, provided in the second case section 22. The case halves 11 may also be releasably attached by latches 95 of the pin-and-sleeve dual halfhinge type as aforementioned. Each case half 11 may also be provided with a conventional handle 71. A toothed or flexible racktype drive belt 51 runs peripherally through a channel 39 in the second case section 22.

Figure 2:
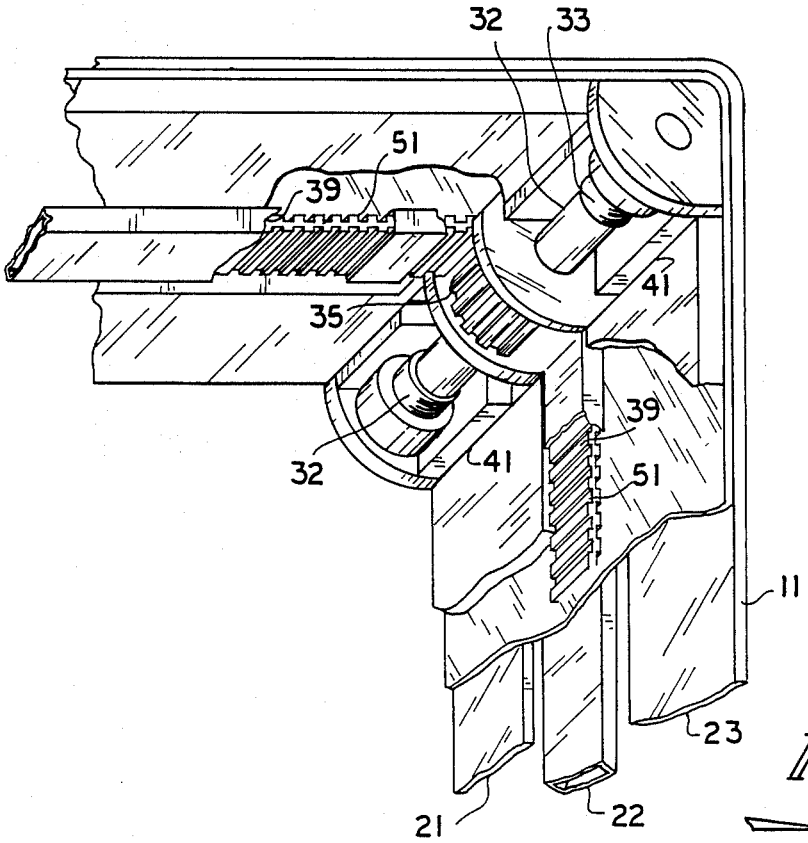
FIG. 2 is a fragmentary isometric, partially cutaway view of the mechanism at each corner of each case section.

As will be apparent from consideration of FIGS. 2 and 3, each corner of each case half 11 is provided with instrumentalities for expanding or contracting the case half 11. Each corner of the first and third case sections 21, 23 is provided with a threaded housing 41. A drive shaft 32 in each corner has, respectively, right hand and left hand threaded shaft portions 33 at each end that are similar in nature to the threads of a turnbuckle and which engage the threaded housing 41. In operation, the drive shaft 32 is rotated by drive belt 51. The drive belt 51, which has rack-like teeth similar to a timing belt, engages a pinion-type drive gear 35 disposed centrally on drive shaft 32. The threads on opposite threaded housings 41, and on drive shaft threaded portions, are in opposite-hand directions so that rotation of the pinion drive gear causes the first and third case half-sections 21 and 23 to be displaced in opposite directions relative to one another and to second case half-section 22.

Figure 4B:
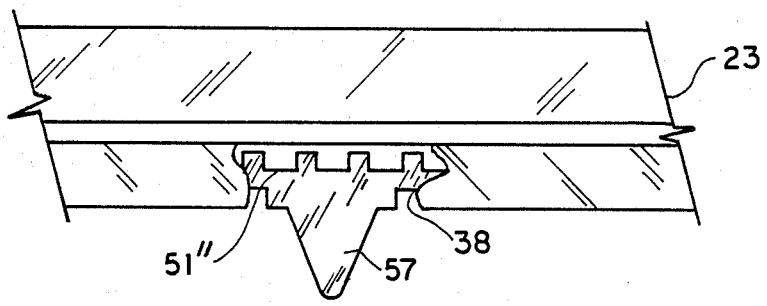
FIG. 4B is a sectional view of the preferred belt control drive device.

As shown in FIG. 4B, in the preferred embodiment the drive belt 51'' may simply and effectively be moved by means of a triangular finger grip 57 protruding from the inside of drive belt 51''. In this embodiment, the channel at 39 has a slot 38 allowing the grip 57 to be manipulated longitudinally from inside the carrying case.

As shown in FIG. 4A, the drive belt 51' may alternatively be moved by a suitable toothed drive wheel 52. A secondary support wheel 55 may be provided to urge the drive belt 51' against drive wheel 52, thereby insuring a positive drive interaction. If this support wheel 55 is provided, it may be enclosed by protective housing 58 disposed on the interior of second case section 22.

Figure 5:
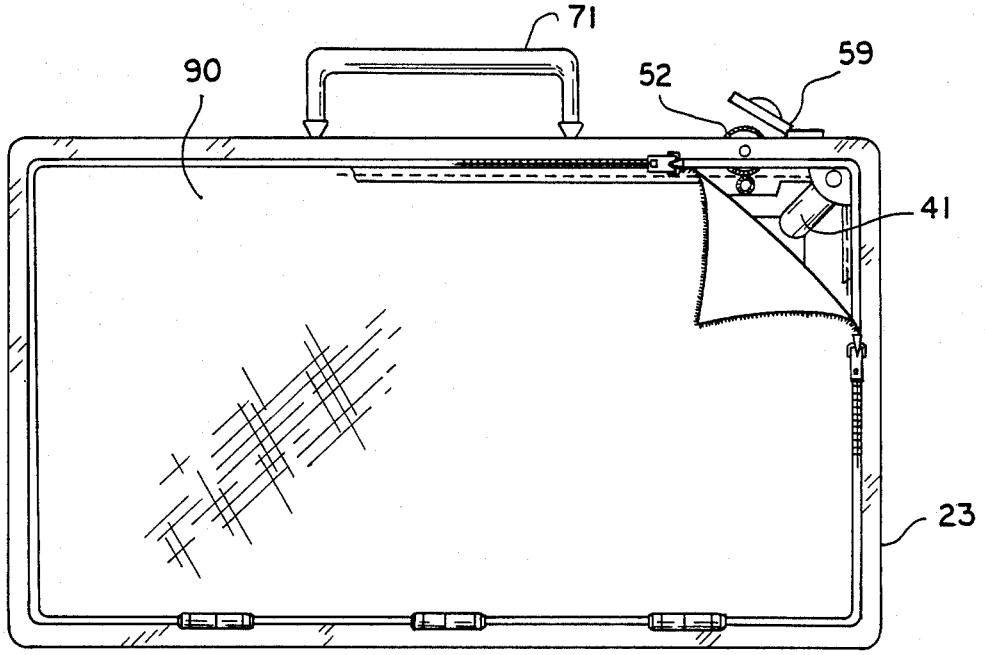
FIG. 5 is a plan view of an alternative embodiment including a removable attached liner that, when attached, allows one case section to be used independently as a separate carrying case.

FIG. 5 shows an alternative embodiment of the invention, wherein one case half 11 may be detached and may be used as a separate carrying case when provided with a removable liner 90. When case half 11 is detached, the removable liner 90 acts as an outer wall of the separate case half 11. This separate case half 11 remains provided with the expansion and contraction means as already described. FIG. 5 also shown an optional control wheel cover 59, which may be hingedly disposed on second case section 22 to cover control wheel 52.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents which may be resorted to, fall within the scope of the claims.

What is claimed is:

1. An expandable carrying case comprising: a pair of hinged case sections;

each case section having three frame members comprising a stationary number and a pair of shell members;

each said shell member having inner and outer walls which are generally parallel to each other, defining a channel therebetween;

said three frame members having at each corner thereof, a pair of nuts and a screw having opposite-hand-threaded screw portions at each end in cooperative engagement therewith;

said nuts and screw having a gear housing, a common drive pinion gear mounted integral with and disposed between the ends of said screw for rotation therewith;

said stationary member being slidably disposed within said channels of said shell members; and means for actuating said drive pinion gear; whereby rotation of said common drive pinion gear causes the plurality of shell members to move with relation to said stationary member, thereby expanding or contracting the case sections as desired.

2. A carrying case as described in claim 1, wherein:

said drive pinion gear actuation means includes a rack-like toothed belt means positioned in a channel disposed on the stationary member, said belt means having the teeth thereon disposed for driving engagement with said drive pinion gear.

3. A carrying case as described in claim 2, further comprising in combination:

belt control means, said belt control means being constructed and arranged for bidirectional movement whereby it selectively moves the belt means in a preselected direction.

4. A carrying case as described in claim 3, wherein said belt control means includes a control wheel disposed on said stationary member, whereby the user of said case can expand or contract the case from the exterior thereof.

5. A carrying case as described in claim 3, wherein said belt control means includes a grip protruding from said belt means.

6. An expandable carrying case as described in claim 4, wherein one of said pair of shell members has a wall perpendicular to the inner and outer walls thereof, forming the exterior shell of the case.

7. A carrying case as described in claim 6, wherein:

the edge of the other of said pair of shell members has a zipper as a fastening means thereon for securing an inner liner on said case section.

8. An expandable carrying case as described in claim 5, having a plurality of separable hinges comprising separable hinge elements wherein:

in each of said case sections, one of said pair of shell members has a wall perpendicular to the inner and outer walls thereof, forming an opposing exterior shell of the case, and the other of said pair of shell member s includes enclosure means, whereby detachment of said separable hinge elements between said case sections provide s for two self-contained expandable carrying cases.

* * * * *